US005420603A

United States Patent [19]

Tsuboyama et al.

[11] Patent Number: 5,420,603

[45] Date of Patent: May 30, 1995

[54] DISPLAY APPARATUS

[75] Inventors: Akira Tsuboyama, Atsugi; Hiroshi Inoue, Yokohama; Katsuhiro Miyamoto, Isehara; Kazunori Katakura; Osamu Yuki, both of Atsugi, all of Japan

[73] Assignee: Canon Kabushiki Kaisha, Tokyo, Japan

[21] Appl. No.: 835,855

[22] Filed: Feb. 18, 1992

[30] Foreign Application Priority Data

Feb. 20, 1991 [JP] Japan ..... 3-045627
Jul. 24, 1991 [JP] Japan ..... 3-206185

[51] Int. Cl.[6] ..... G09G 3/36

[52] U.S. Cl. ..... 345/87; 345/97; 359/55

[58] Field of Search ..... 340/784, 805; 359/55, 359/56; 345/87, 94, 97

[56] References Cited

U.S. PATENT DOCUMENTS 4,639,089 1/1987 Okada et al. .
4,681,404 7/1987 Okada et al. .
4,682,858 7/1987 Kanbe et al. .
4,712,873 12/1987 Kanbe et al. .
4,712,874 12/1987 Sekimura et al. .
4,712,875 12/1987 Tsuboyama et al. .
4,712,877 12/1987 Okada et al. .
4,714,323 12/1987 Katagiri et al. .
4,728,176 3/1988 Tsuboyama et al. .
4,738,515 4/1988 Okada et al. .
4,740,060 4/1988 Komura et al. .
4,765,720 8/1988 Toyono et al. .
4,778,259 10/1988 Kitayama et al. .
4,796,979 1/1989 Tsuboyama .
4,796,980 1/1989 Kaneko et al. .
4,859,036 8/1989 Yamanaka et al. .
4,932,757 6/1990 Hanyu et al. .
4,932,758 6/1990 Hanyu et al. .
4,952,032 8/1990 Inoue et al. ..... 340/784
5,000,545 3/1991 Yoshioka et al. .
5,007,716 4/1991 Hanyu et al. .

FOREIGN PATENT DOCUMENTS 0350934 1/1990 European Pat. Off. .
0394814 10/1990 European Pat. Off. .
0421772 4/1991 European Pat. Off. .

*Primary Examiner*—Alvin E. Oberley
*Assistant Examiner*—Matthew Luu
*Attorney, Agent, or Firm*—Fitzpatrick, Cella, Harper & Scinto

[57] ABSTRACT

A technique for driving a liquid crystal apparatus having an effective display area and a non-display unit area is provided. When a bistable liquid crystal element is used, a voltage must be continuously applied to the non-display unit area to maintain a uniform white or black display state. Durability of the non-display unit is particularly desired. In this invention, the non-display unit includes first and second stripe electrodes disposed perpendicular to each other. First and second drive bipolar pulses are respectively applied to the first and second stripe electrodes with a phase difference between these bipolar pulses.

9 Claims, 7 Drawing Sheets

DISPLAY APPARATUS

BACKGROUND OF THE INVENTION

1. Field of the Invention

The present invention relates to an element using a chiral smectic liquid crystal exhibiting ferroelectric characteristics and a display apparatus using the same.

2. Related Background Art

Display apparatuses using ferroelectric chiral smectic liquid crystals are disclosed in, e.g., U.S. Pat. Nos. 4,639,089, 4,681,404, 4,682,858, 4,712,873, 4,712,874, 4,712,875, 4,712,877, 4,714,323, 4,728,176, 4,738,515, 4,740,060, 4,765,720, 4,778,259, 4,796,979, 4,796,980, 4,859,036, 4,932,757, 4,932,758, 5,000,545, and 5,007,716. In each display apparatus of these prior art patents, transparent electrodes are formed on the inner surfaces of opposite glass substrates aligned by rubbing and spaced apart from each other by a cell gap of 1 to 3 μm to constitute a liquid crystal cell, and a ferroelectric chiral smectic liquid crystal (to be referred to as an FLC hereinafter) is sealed in the liquid crystal cell.

This liquid crystal device (panel) is inserted and fixed in a housing and is utilized as a display apparatus. When the liquid crystal panel is mounted using the housing, the upper surface of the housing is higher than the upper surface of the liquid crystal panel. In this arrangement, a display unit of the panel cannot be entirely observed when viewed from an oblique direction. For this reason, a non-display unit having a width of about 5 to 10 mm is formed around the display unit to improve readability of information displayed on the panel.

When a bistable liquid crystal element is used, any signal is preferably applied to this non-display unit to define a non-display unit (i.e., a display frame) for displaying a peripheral portion of an effective display area formed by matrix electrodes in white or black. Since a drive voltage is continuously applied to maintain the display frame in a uniform "white" or "black" display state, durability of the liquid crystal apparatus must be improved.

SUMMARY OF THE INVENTION

It is an object of the present invention to provide a display apparatus having improved durability.

In order to achieve the above object of the present invention, there is provided a display apparatus comprising:

a. a liquid crystal panel having an effective display area formed by matrix electrodes constituted by scan and information electrodes perpendicular to each other at predetermined pitches, a non-display area constituted by first stripe electrodes which are parallel to the scan electrodes arranged outside the matrix electrodes and are perpendicular to the information electrodes at predetermined pitches, and second stripe electrodes which are parallel to the information electrodes arranged outside the matrix electrodes and are perpendicular to the scan electrodes at predetermined pitches, and a liquid crystal sealed between the scan and information electrodes;

b. first means for driving the matrix electrodes;

c. second means for applying a first bipolar pulse exceeding a threshold value of the liquid crystal to intersections between the first stripe and information electrodes;

d. third means for applying a second bipolar pulse exceeding the threshold value of the liquid crystal to intersections between the second stripe and scan electrodes; and e. fourth means for shifting a phase of the first bipolar pulse from that of the second bipolar pulse.

DETAILED DESCRIPTION OF THE PREFERRED EMBODIMENTS

Figure 1:
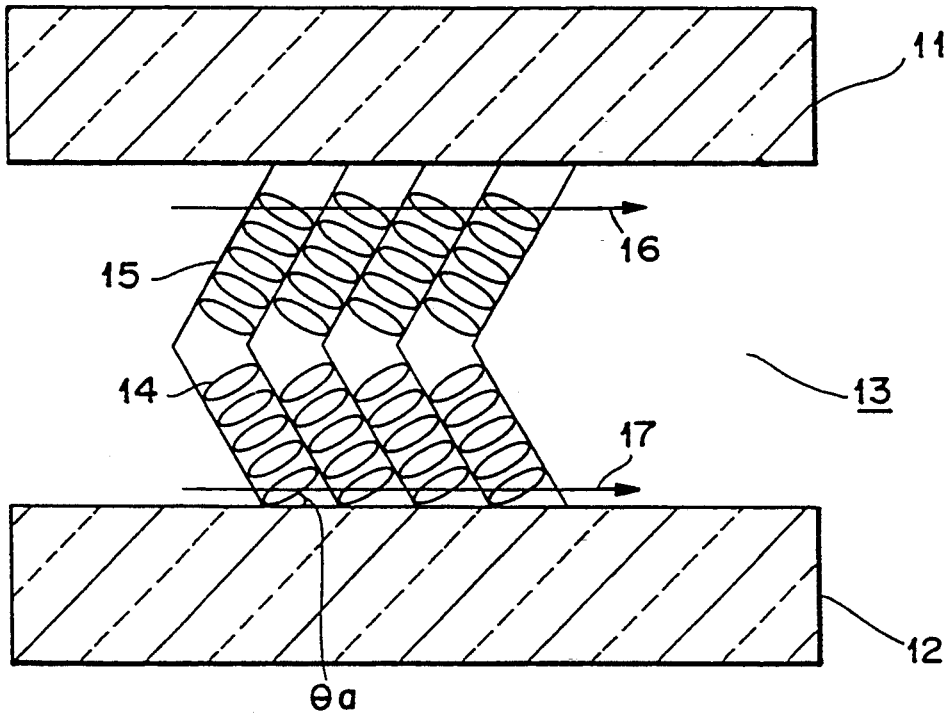
FIG. 1 is a sectional view of a liquid crystal used in the present invention.

An element obtained by aligning an FLC upon formation of a chevron structure has an excellent bright (light) state under the crossed nicols, and a sufficiently high contrast can be obtained. FIG. 1 is a sectional view showing an alignment state of the FLC sealed between substrates 11 and 12. An FLC 13 has layers 15 constituted by a plurality of liquid crystal molecules 14. The plurality of layers 15 are aligned in the same direction and constitute a chevron structure. In this case, the major axis of each of the liquid crystal molecules 14 is preferably inclined at a pretilt angle $\theta a$ of 5° or more from the substrates 11 and 12. The above alignment state is preferably obtained by aligning the substrates 11 and 12 in rubbing directions 16 and 17.

Figure 2A:
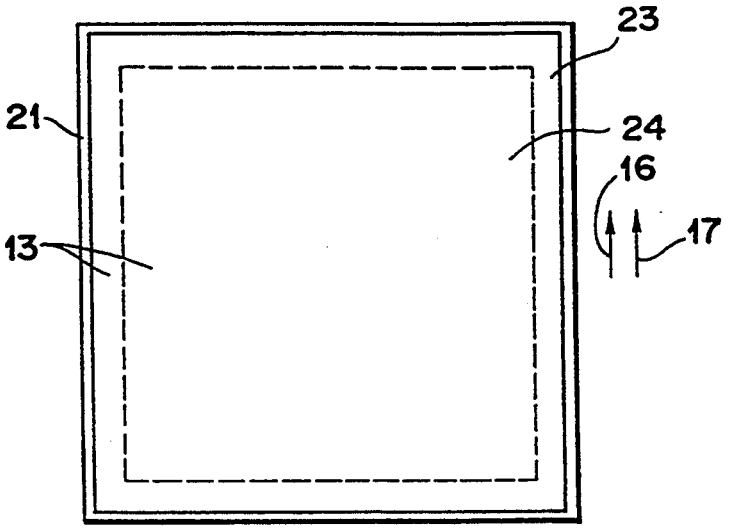
FIGS. 2(*a*) to 2(*c*) are plan views of a liquid crystal panel used in the present invention.
Figure 2B:
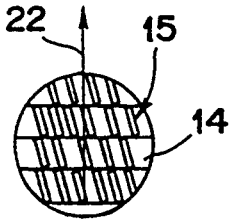
Figure 2C:
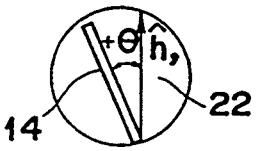

FIGS. 2(*a*) to 2(*c*) are plan views of an element in which the FLC 13 having the chevron structure is sealed. A seal member 21 seals a gap between the substrates 11 and 12. Although not shown, a first group of scan electrodes for receiving a voltage are arranged in the element, and a second group of information electrodes perpendicular to the first group of scan electrodes are arranged in the element to constitute matrix electrodes. The area of the matrix electrodes corresponds to an effective display area 24. A frame display unit 23 defines a non-display area. A direction normal 22 to each layer 14 (plane) of the FLC 13 is substantially parallel to the rubbing directions 16 and 17. In the element shown in FIGS. 2(*a*) to 2(*c*), the liquid crystal molecules 15 are uniformly inclined at a tilt angle of $+\theta$ to the left on the plane (spontaneous polarization is directed from the upper surface of the drawing sheet to the lower surface thereof).

Figure 3:
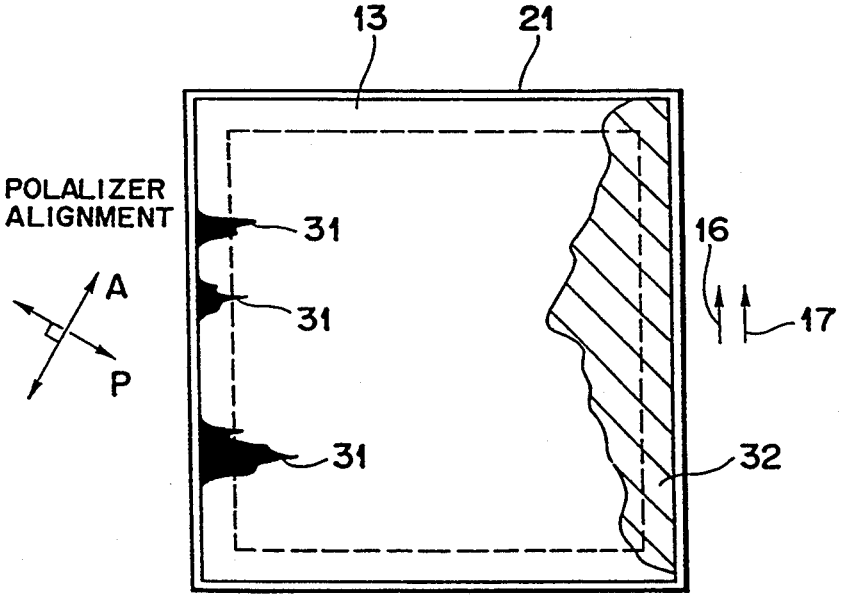
FIG. 3 is a plan view showing a liquid crystal panel used in the present invention.

According to findings of the experiments of the present inventors, when a voltage (e.g., an 10-Hz AC voltage of ±8 V) is applied to the effective display area 24 and the frame display unit 23 in the above state, the liquid crystal molecules 15 start to flow in the right direction. When the voltage is continuously applied for a long period of time (e.g., 20 to 50 hours), areas 31 in which the liquid crystal molecules 14 are reduced or depleted are formed in the left portion, as shown in FIG. 3. An area 32 in which the liquid crystal molecules 14 are increased is formed in the right portion. As a result, an interference color appears on the entire surface of the element, thereby degrading the display quality.

When the liquid crystal 15 in FIG. 2(*c*) is inclined at a tilt angle of $-\theta$ to the right on the plane (spontaneous polarization is directed from the lower surface of the drawing sheet to the upper surface), it is also found that the liquid crystal molecules start to flow to the left.

Figure 4:
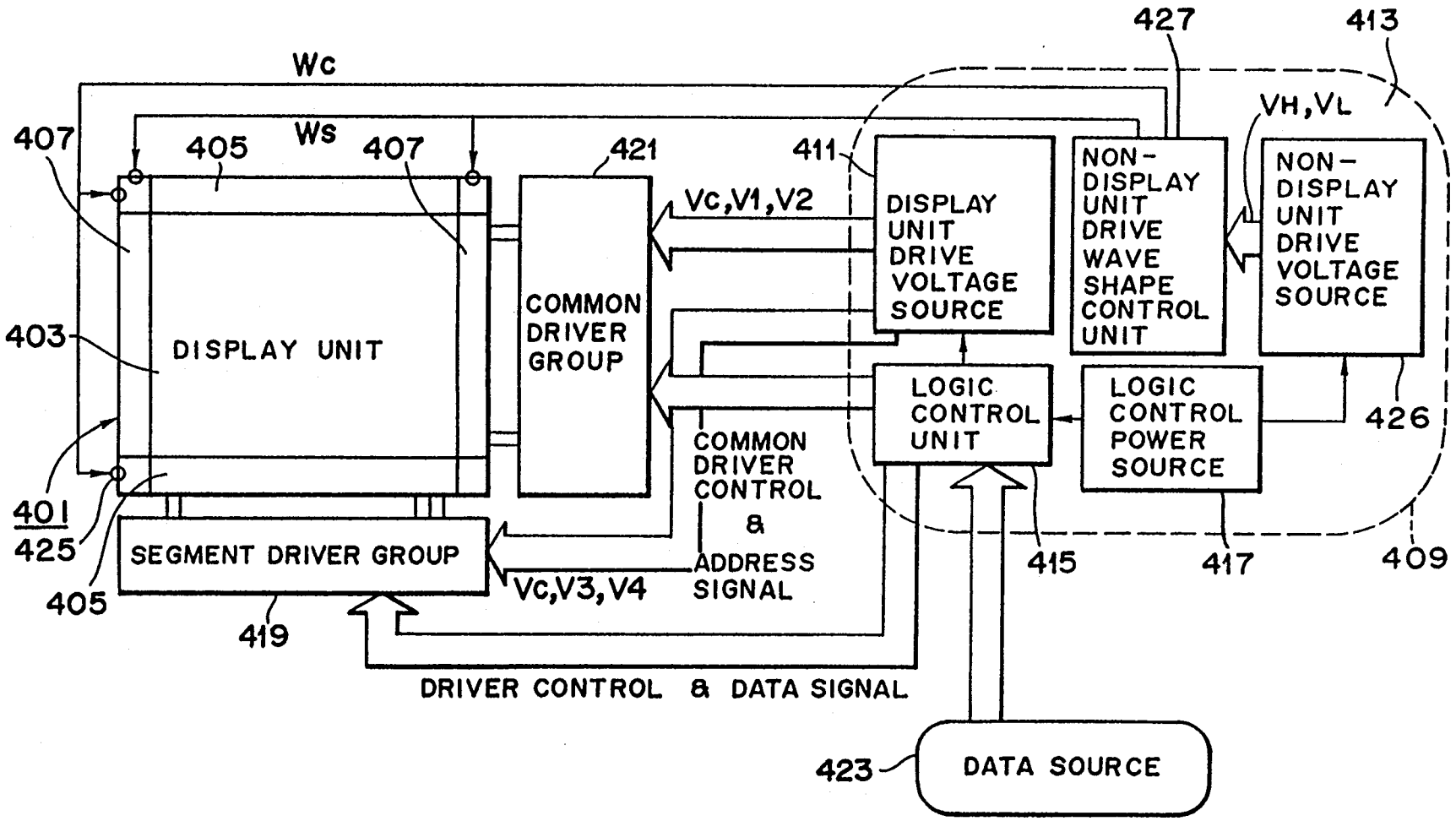
FIG. 4 is a block diagram of a liquid crystal apparatus according to an embodiment of the present invention.

FIG. 4 is a block diagram of a liquid crystal display apparatus according to an embodiment of the present invention. This apparatus comprises an FLC panel 401 having 640 (information lines)×480 (scan lines) pixels. A non-display area adjacent to a display unit 403 is constituted by scan and signal electrodes respectively present in a common non-display unit 405 and a segment non-display unit 407. The apparatus also comprises an FLC panel controller 409 which includes a display unit drive voltage source 411, a non-display unit drive voltage source 426, a non-display unit drive waveshape control unit 427, a non-display unit drive waveshape control unit 413, a logic control unit 415, and a logic control power source 417. These components of the FLC panel controller 409 perform all control operations of the FLC panel 401 such as setup of drive conditions (e.g., a drive waveshape and a drive voltage), control of the segment and common driver groups 419 and 421, control of communication between a data source 423 and the driver groups 419 and 421, and control of drive waveshapes of the non-display unit. Voltages VH and VL (to be described in detail later) are used as drive waveshape voltages of the non-display unit.

Figure 5:
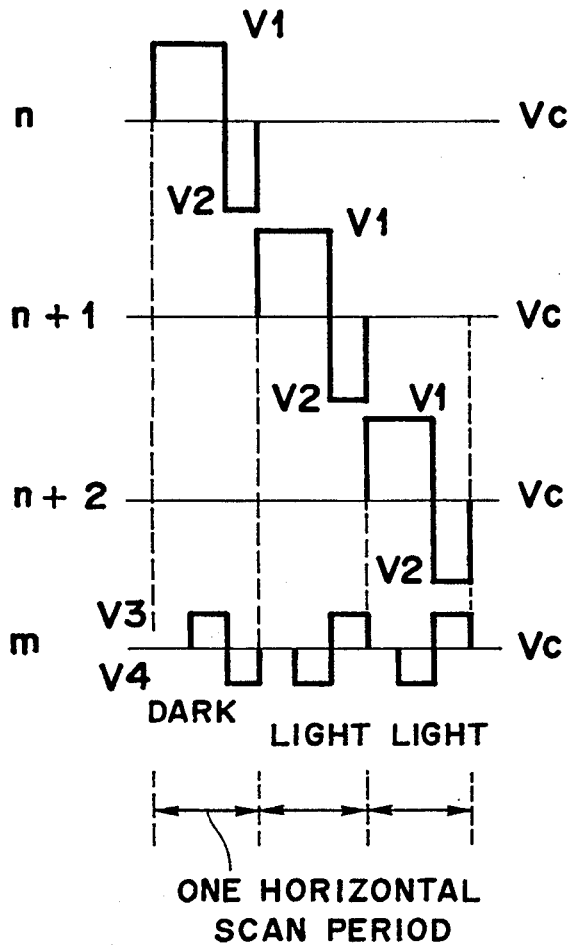
FIG. 5 is a waveshape chart for drive signals for drawing a desired pattern on a display unit in the apparatus shown in FIG. 4.

FIG. 5 shows drive waveshapes for driving a desired pattern on the display unit 403. As shown in FIG. 5, when an information signal m is superposed on scan signals n to n+2, the (n,m) pixel is set in a dark state, and the (n+1,m) and (n+2,m) pixels are set in a bright (light) state. Drive conditions for properly drawing the pattern are V1=15 V, V2=−15 V, V3=6 V, V4=−6 V, and 1H period (one horizontal scan period)=80 μsec at room temperature. Note that voltage values are potential differences from Vc.

Figure 6A:
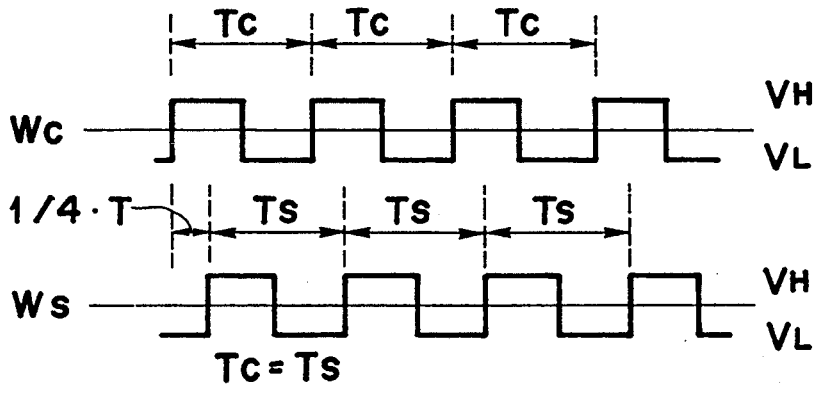
FIGS. 6A and 6B are a waveshape chart of signals applied to scan electrodes of a common non-display unit and information electrodes of a segment non-display unit, and a waveshape chart of a signal finally applied to non-display electrode intersections when the phases of the above signals are shifted by ¼ from each other.
Figure 6B:
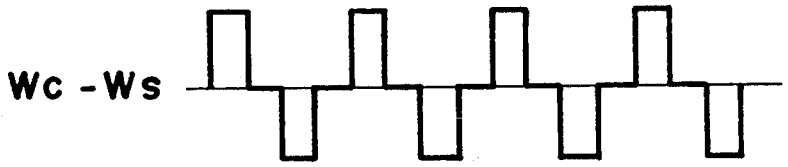

FIG. 6A is a waveshape chart of drive waveshapes Wc and Ws respectively applied to the scan electrodes of the common non-display unit 405 and information electrodes of the segment non-display unit 407. Voltage levels are obtained by simple rectangular waves using the voltages VH and VL. The rectangular waves must have periods Tc and Ts (Tc=Ts) for sufficiently switching between the bright and dark states and must have frequencies higher than those visually noticed by an observer, thereby suppressing flickering. According to the present inventors, it is found that flickering can be sufficiently suppressed in a practical level when a frequency of a drive waveshape for the non-display unit is 30 Hz or more (i.e., the period is 33.3 msec or less). In this embodiment, the frequency of the non-display unit drive waveshape is set to be 50 Hz (one period=20 msec). The period of the signal on the common side is equal to that on the segment side, but the phase of the signal on the common side is shifted to that on the segment side by $\frac{1}{4}$ because a sufficient voltage is applied to non-display electrode intersections at four corners. More specifically, when in-phase voltages are applied to the electrodes, an electric field is not applied to the non-display electrode intersections 425 to fail to control the intersections 425. As a result of extensive studies by the present inventors, uniform control free from a difference in hue can be performed by shifting the phases of the voltages by $\frac{1}{8}$ to $\frac{7}{8}$. FIG. 6B shows a waveshape (Wc−Ws) finally applied to the non-display electrode intersection 425 when the phases are shifted from each other by $\frac{1}{4}$. When the liquid crystal panel is driven under the above conditions, both the display unit and the non-display unit can be controlled to be set in the uniform display state.

Figure 7:
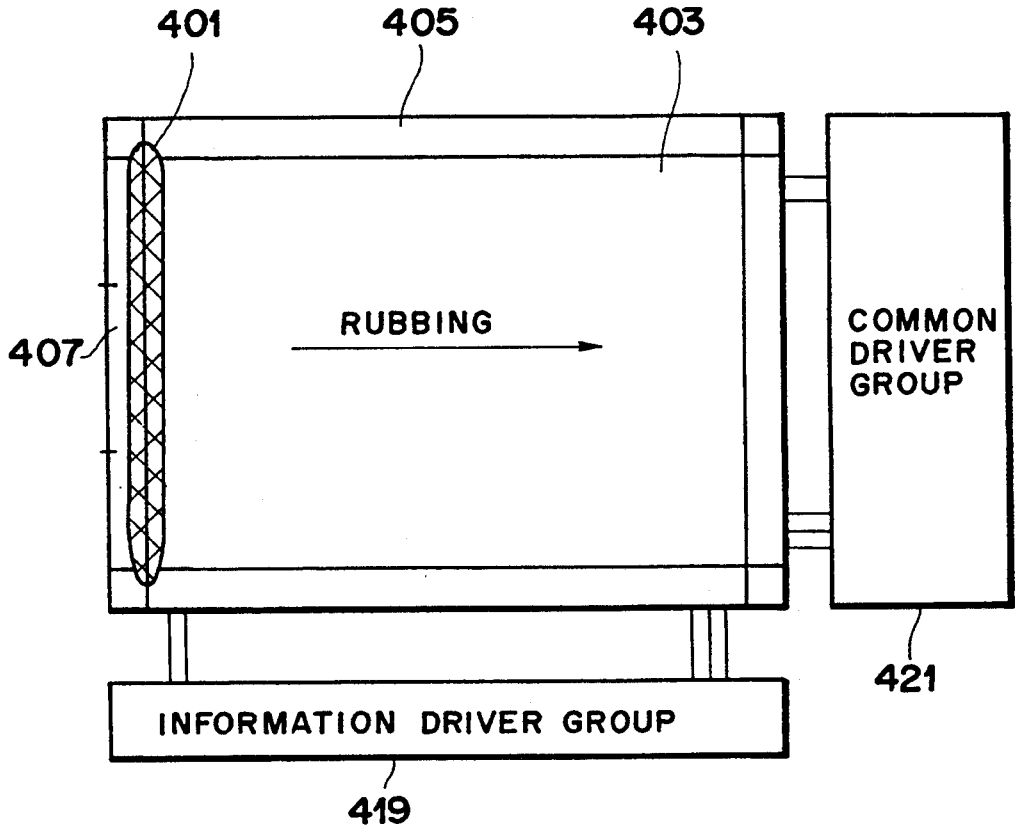
FIG. 7 is a view illustrating a liquid crystal air gap portion formed between the display and non-display units of the apparatus.

With the above arrangement, peak values (i.e., potential differences from Vc) of the respective drive waveshapes shown in FIG. 5 were set to be values defined by the above excellent drive conditions, i.e., V1=15 V, V2=−15 V, V3=6 V, and V4=−6 V, and a drive waveshape voltage for the non-display unit was set to be VH=−VL=2 to 10 V. The FLC panel was driven under the above conditions. When a predetermined drive period had elapsed, an air gap 401 as a defect was formed between the display unit 403 and the non-display unit 407, as shown in FIG. 7. A relationship between the drive periods until the defect is caused and the drive waveshape voltages VH and VL is shown in Table 1 in which voltages of 2, 4, 5, and 6 V within the range of the present invention, i.e., VH=−VL <6 V (peak value of information electrode signal) are applied in Examples 1 to 4, and voltages of 8 and 10 V falling outside the range of the present invention are applied in Comparative Examples 1 and 2.

TABLE 1

| | VH = −VL [V] | Drive Time [hours] |
|---|---|---|
| Example 1 | 2 | No defect in 1,000 hours |
| Example 2 | 4 | No defect in 1,000 hours |
| Example 3 | 5 | No defect in 1,000 hours |
| Example 4 | 6 | No defect in 1,000 hours |
| Comparative Example 1 | 8 | Defect in 400 hours |
| Comparative Example 2 | 10 | Defect in 350 hours |

As is apparent from Table 1, in Examples 1 to 4 wherein the peak values (VH and VL) of the non-display drive unit voltages are smaller than those (V3 and V4) of the information signal voltages, durability and reliability can be greatly improved as compared with Comparative Examples 1 and 2.

It is assumed that the air gap is formed due to the following mechanism. A ferromagnetic liquid crystal layer having a thickness of several μm or less receives a strong electric field of a voltage falling between 20 V and 30 V, and a difference in stress caused by deformation of the layer structure unique to the FLC element is caused to shift liquid crystal molecules within the panel due to some reason. When an electric field stronger than that applied to the display unit is applied to the non-display unit as in the comparative examples, and the period of the drive waveshape for the non-display unit is shorter than the period of the drive waveshape of the display unit by about 100 times, a defect tends to be caused. However, a torque generation mechanism and the like in movement of the liquid crystal are not yet clarified.

Figure 8:
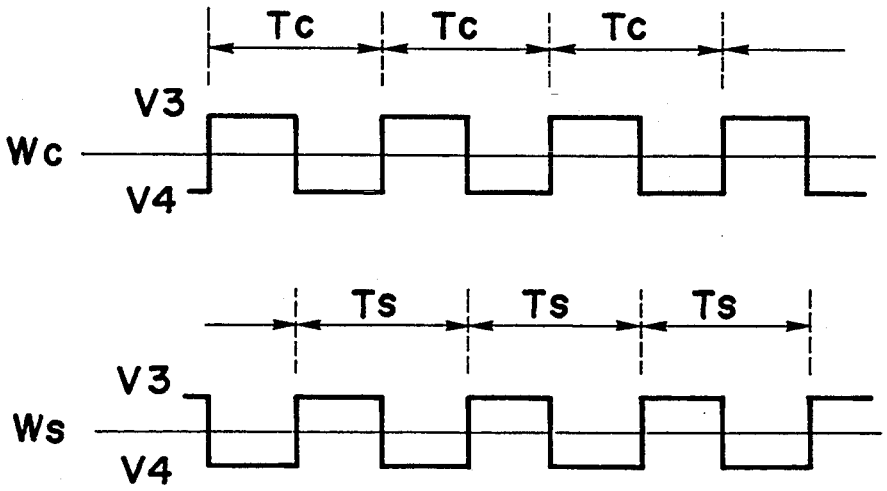
FIG. 8 is a waveshape chart of other signals applied to the scan electrodes of the common non-display unit and the information electrodes of the segment non-display unit in the apparatus of FIG. 4.
Figure 9:
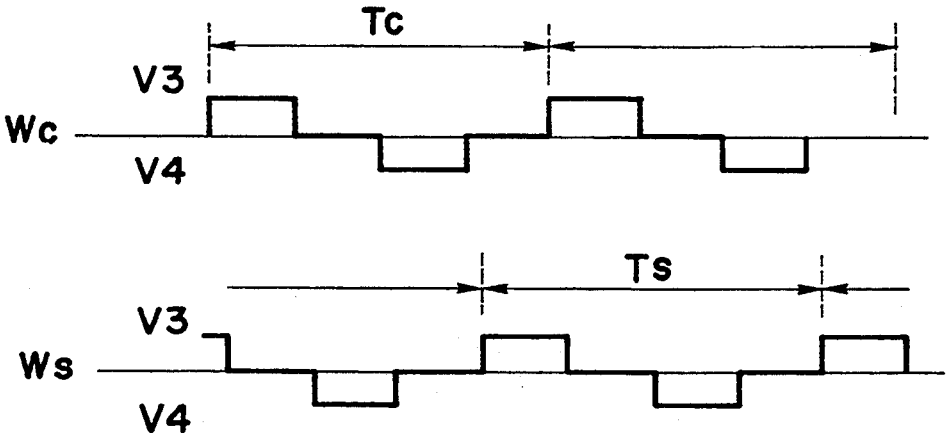
FIG. 9 is a waveshape chart of still other signals applied to the scan electrodes of the common non-display unit and the information electrodes of the segment non-display unit in the apparatus of FIG. 4.

Another preferred embodiment of the present invention is shown in FIGS. 8 and 9. For example, as shown in FIG. 8, when 50-Hz period drive waveshapes Wc and Ws having a $\frac{1}{4}$ phase difference are applied to the FLC panel as in FIG. 6A, excellent image quality can be obtained. Even if 50-Hz period drive waveshapes Wc and Ws having a $\frac{3}{4}$ phase difference are applied to the FLC panel, as shown in FIG. 9, the non-display unit can be uniformly controlled, thereby obtaining excellent image quality.

According to the present invention, as has been described above, since electric fields exceeding the first and second threshold values enough to set the first and second stable states are alternatively applied to the ferroelectric liquid crystal of the non-display unit at a predetermined period, the non-display unit can be substantially maintained at a predetermined brightness level as an intermediate level between the bright (light) and dark states. Since the voltage peak value of the non-display unit drive signal is smaller than the voltage peak value of the information electrode signal, a period for undesirably forming an air gap between the display unit and the non-display unit parallel to the information electrode group can be greatly prolonged. As a result, reliability and durability of the apparatus can be greatly improved.

What is claimed is:

1. A display apparatus comprising:

a liquid crystal panel having an effective display area formed by matrix electrodes formed by scan and information electrodes perpendicular to each other, a non-display area formed by first stripe electrodes which are parallel to said scan electrodes arranged outside said matrix electrodes and are perpendicular to said information electrodes, and second stripe electrodes which are parallel to said information electrodes arranged outside said matrix electrodes and are perpendicular to said scan electrodes, and a liquid crystal sealed between said scan and information electrodes;

first means for driving said matrix electrodes;

second means for applying a first continuous bipolar AC pulse, with one pulse of said AC pulse exceeding a threshold value of the liquid crystal, to said first stripe;

third means for applying a second continuous bipolar AC pulse with one pulse of said AC pulse exceeding a threshold value of the liquid crystal, to said second stripe; and fourth means for shifting a phase of the first continuous bipolar AC pulse from that of the second continuous bipolar AC pulse.

2. An apparatus according to claim 1, wherein the liquid crystal is a ferroelectric liquid crystal.

3. An apparatus according to claim 1, wherein said fourth means comprises means for shifting the phase of the first bipolar pulse from the phase of the second bipolar pulse within a range of $\frac{1}{8}$ to $\frac{7}{8}$.

4. An apparatus according to claim 1, wherein the first and second bipolar pulses have a frequency of not less than 30 Hz.

5. A display apparatus comprising:

an effective display area formed by matrix electrodes formed by scan and information electrodes perpendicular to each other, a non-display area formed by first stripe electrodes which are parallel to said scan electrodes arranged outside said matrix electrodes and are perpendicular to said information electrodes, and second stripe electrodes which are parallel to said information electrodes arranged outside said matrix electrodes and are perpendicular to said scan electrodes, and a liquid crystal sealed between said scan and information electrodes;

first means for applying an information signal to said information electrodes in synchronism with application of a scan select signal to a selected scan electrode upon sequential scan of said scan electrodes;

second means for applying a first continuous bipolar AC pulse, with One pulse of said AC pulse exceeding a threshold value of the liquid crystal, to said first stripe;

third means for applying a second continuous bipolar AC pulse, with one pulse of said AC pulse exceeding a threshold value of the liquid crystal, to said second stripe; and fourth means for shifting a phase of the first continuous bipolar AC pulse from that of the second continuous bipolar AC pulse.

6. An apparatus according to claim 5, wherein the first and second bipolar pulses have voltage peak values smaller than that of the information signal and have a pulse width larger than that of the information signal.

7. An apparatus according to claim 6, wherein the first and second bipolar pulses have a frequency of not less than 30 Hz.

8. An apparatus according to claim 5, wherein said fourth means comprises means for shifting the phase of the first bipolar pulse from the phase of the second bipolar pulse within a range of $\frac{1}{8}$ to $\frac{7}{8}$.

9. An apparatus according to claim 5, wherein the liquid crystal is a ferroelectric liquid crystal.

* * * * *

UNITED STATES PATENT AND TRADEMARK OFFICE

CERTIFICATE OF CORRECTION

PATENT NO. : 5,420,603

DATED : May 30, 1995

INVENTOR(S) : Tsuboyama et al.

It is certified that error appears in the above-indentified patent and that said Letters Patent is hereby corrected as shown below:

In the drawing:

FIG. 3, "POLALIZER" should read --POLARIZER--.

Signed and Sealed this

Fourteenth Day of November, 1995

Bruce Lehman

*Attest:*

BRUCE LEHMAN

*Attesting Officer*

*Commissioner of Patents and Trademarks*